United States Patent [19]

David

[11] Patent Number: 5,000,076

[45] Date of Patent: Mar. 19, 1991

[54] AUTOMATIC SAFETY RELEASE FOR FIREARMS

[75] Inventor: James C. David, Bakersfield, Calif.

[73] Assignee: Mr. Gasket Company, Cleveland, Ohio

[21] Appl. No.: 453,979

[22] Filed: Dec. 20, 1989

[51] Int. Cl.[5] ..... F41A 17/74

[52] U.S. Cl. ..... 89/148; 89/154

[58] Field of Search ..... 42/70.04, 70.05; 89/148, 149, 150, 154

[56] References Cited

U.S. PATENT DOCUMENTS

| | | | |
|---|---|---|---|
| 814,854 | 3/1906 | Lehmann | 89/142 |
| 1,381,590 | 6/1921 | Oliver | 89/154 |
| 1,753,072 | 4/1930 | Stange | 89/141 |
| 2,341,033 | 2/1944 | Garland | 89/144 |
| 2,390,061 | 12/1945 | Ekland | 89/150 |
| 2,422,854 | 6/1947 | Reising | 89/145 |
| 2,427,304 | 9/1947 | Robbins | 89/149 |
| 2,453,897 | 11/1948 | Eklund | 89/148 |
| 2,462,130 | 2/1949 | Rudd | 89/141 |
| 2,807,196 | 9/1957 | Saetter-Lassen | 89/148 |
| 3,159,080 | 12/1964 | Freid | 89/148 |
| 3,857,324 | 12/1974 | Tantl | 89/148 |
| 4,522,105 | 6/1985 | Atchisson | 89/139 |
| 4,589,327 | 5/1986 | Smith | 89/148 |
| 4,704,944 | 11/1987 | Bercu | 89/132 |

*Primary Examiner*—Stephen C. Bentley

*Attorney, Agent, or Firm*—Roylance, Abrams, Berdo & Goodman

[57] ABSTRACT

An improved dual functioning safety mechanism for all weapons having moveable bolts. The invention permits conventional operation of the safety by a manual lever external of the weapon. The improvement is an arrangement of parts responsive to manual cocking of the bolt to automatically move the safety from the "SAFE" to the "FIRE" position. This enables law enforcement and military personnel to immediately fire upon cocking the weapon without the additional necessary step in conventional weapons of disengaging the safety manually. At the same time, the usual advantages of a manual safety are provided.

7 Claims, 1 Drawing Sheet

AUTOMATIC SAFETY RELEASE FOR FIREARMS

FIELD OF THE INVENTION

This invention relates to firearms of all sorts that have a moveable bolt, including single shot, automatic, and semi-automatic guns. More in particular, it relates to the safety mechanism for such firearms. A "safety" for a firearm is a mechanism in the weapon which, when in the "SAFE" position, disenables the weapon from firing. When the safety is moved to the "FIRE" position, the weapon is then enabled to fire.

BACKGROUND OF THE INVENTION

The problem to which the present invention is directed is experienced primarily by law enforcement and military personnel. More specifically, the problem is that when the weapon is in the "SAFE" position, and the police officer or soldier desires to shoot on a more or less emergency basis, as by encountering a criminal or an enemy, time is lost in manually moving the safety lever or other operating member from the "SAFE" position to the "FIRE" position. At the same time, the police officer or soldier desires to have the conventional safety capability so that the gun will be disenabled form firing at certain times, as when it is stored in a closet at home or being carried in a vehicle or on the user's person in a non-combat atmosphere. However, in emergency situations, it is highly desirable that the user could simply manually cock the weapon, and in the act of doing so, move the safety from the "SAFE" to the "FIRE" position, thus immediately, in the act of cocking only, enable the gun to shoot.

SUMMARY OF THE INVENTION

The present invention provides a simple set of parts associated with the bolt and the firing mechanism to allow this dual mode of operation. The safety according to the invention can be operated in the usual manner by being manually moved between the "SAFE" and "FIRE" positions. Also, there is a kind of manual override operated by the bolt. That is, when the user cocks the weapon by moving the bolt, this automatically moves the safety from the "SAFE" to the "FIRE" position.

There are cases of loss of life by police officers in having to fumble with the safety mechanisms of their weapons while the criminals they are attempting to control immediately fire and injure and even kill such police officers. The present invention solves this problem by permitting the officer to not worry at all about the safety mechanism. When he wants to fire, he simply cocks the weapon, this throws the safety into "FIRE", and he is ready to shoot immediately after cocking his weapon. This is a very significant step forward in the art of firearms. It is applicable to any sort of firearm having a moving bolt. This includes automatic and semi-automatic weapons, as well as single shot weapons.

The step forward wrought by the invention is of substantial significance in that it can actually save the lives of police officers and military personnel in emergency situations.

The invention, is applicable to all types of bolt action weapons, including, but not limited to rifles, assault rifles, machine guns, carbines, pistols, and other such weapons, as will be clear to those skilled in these arts.

BRIEF DESCRIPTION OF THE FIGURES OF THE DRAWINGS

This invention will be best understood after a careful reading of the following detailed description taken together with the attached drawings, which drawings also form a part of this disclosure, and in which.

DETAILED DESCRIPTION OF THE PREFERRED EMBODIMENT

Figure 1:
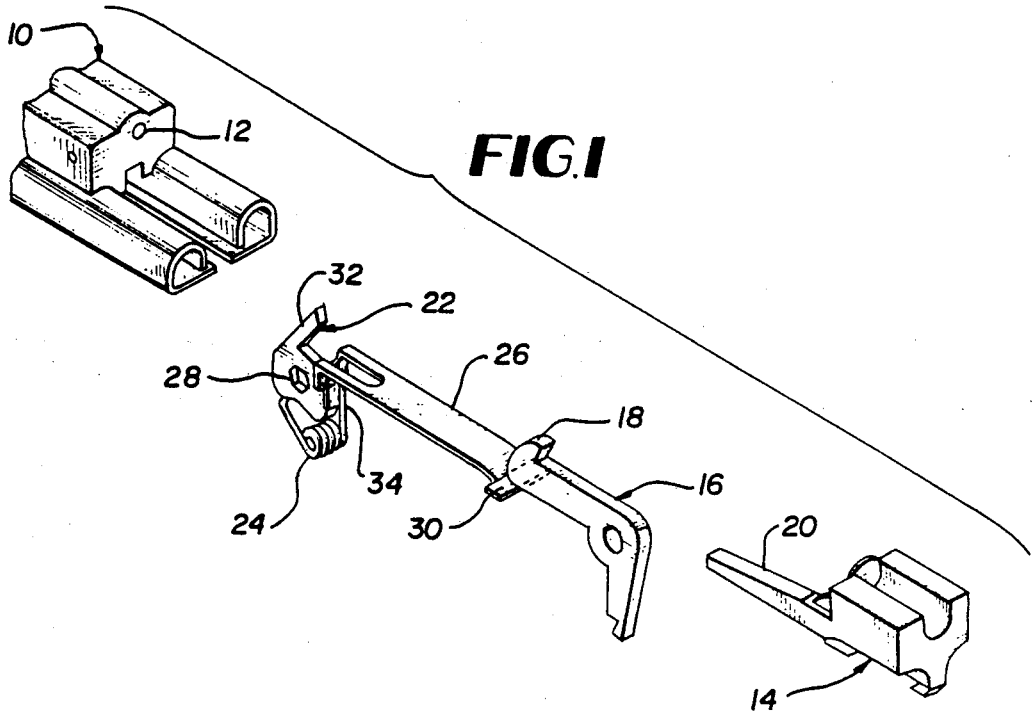
FIG. 1 is a partial exploded view showing the bolt of a weapon, the operating sear and the parts of the invention automatic release safety in the "SAFE" position.
Figure 2:
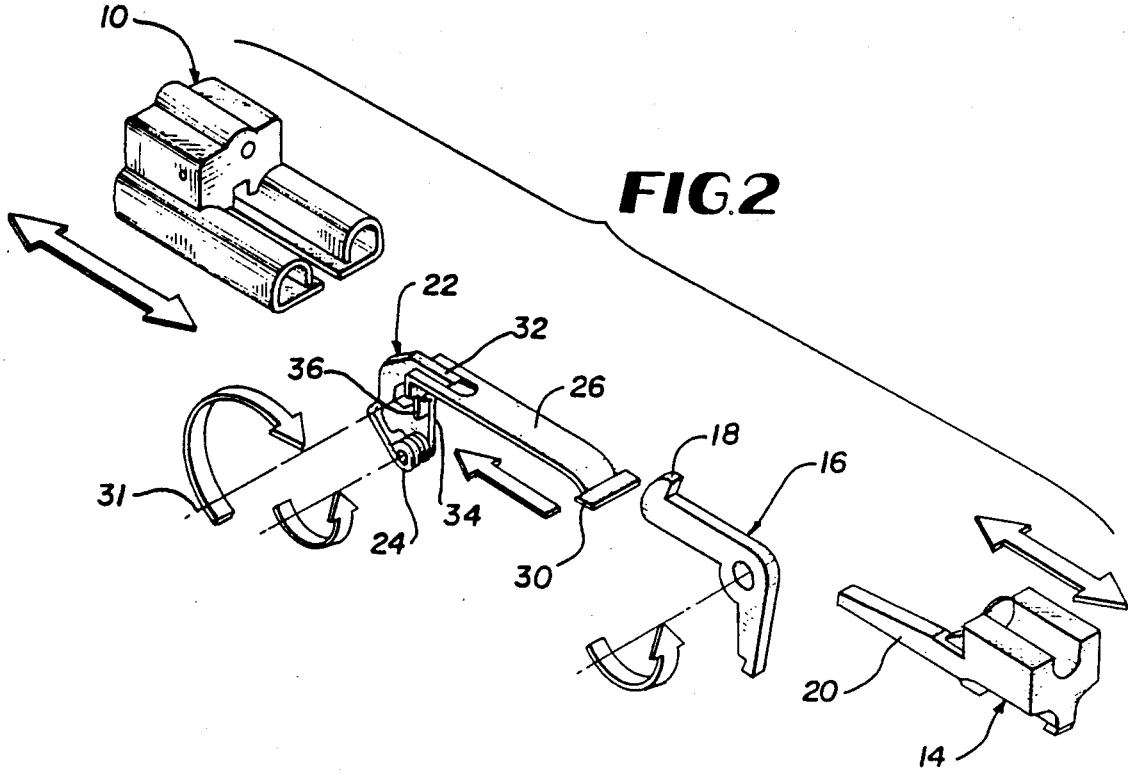
FIG. 2 is a view similar to FIG. 1 showing the same parts in the "FIRE" position.

Referring now to FIG. 1, the invention works in conjunction with any sort of weapon as described above, which weapon includes a sliding bolt 10. Conventionally, the bolt 10 carries a firing pin 12. The weapon also includes a striker 14 which slides in the direction of the arrow indicated on FIG. 2. This striker 14 is spring loaded to the left, towards the bolt 10 with its firing pin 12, and upon so moving in that direction, will fire a round in the chamber which is closed off by the bolt 10. A sear 16 is mounted on the weapon, for rotation about the axis at its "knee", as indicated in FIG. 2. Sear 16 is formed with a hook 18 at one end, which engages a finger 20 on the striker 14.

As is clear, the normal functioning of this weapon is that operation of the trigger, not shown, causes rotation of the sear 16 in a counterclockwise direction as indicated by the arrow on FIG. 2. That rotation disengages the hook 18, from the finger 20, permitting the striker to move rapidly to the left under the power of its spring (not shown) to hit the bolt 10 to fire the round.

The invention safety mechanism is of exceedingly simple configuration, and comprises a cam 22, the motion of which is controlled by a spring 24, and which parts operate in conjunction with a sliding sear blocking plate 26. The cam 22 is provided a hexagonal hole into which a hex portion of a rod (not shown) fits. The rod is indicated by the axis 31 in FIG. 2.

As is well known in regard to firearms in general and especially with respect to the type of firearm for which the invention is designed, the two arrows associated with the bolt 10 and striker 14 define a line of motion along which those two elements move. The finger 32 of the cam 22 in the "SAFE" position extends up into this line of motion. Because of that extension up into or across that line of motion, manual cocking of the bolt 10, as indicated by the arrow in FIG. 2, first to the right and then to the left back to the FIG. 2 position, will cause the bolt to strike the finger 32, thus automatically moving the safety mechanism comprising the parts 22, 24, 26 and 30 from the FIG. 1 "SAFE" position to the FIG. 2 "FIRE" position. Likewise, the hook 18 of the sear 16 moves into and out of that line of motion to permit or to check the motion of the striker 14 by engagement or no engagement with the striker finger 20.

OPERATION

As shown in FIG. 1, the cam 22 has been rotated in the counterclockwise direction to its blocking or "SAFE" position. This is accomplished in one way only, by operation of the manual safety shaft (not shown) about the axis 31 by cooperation with the hex hole 28. The various lobes on the cam 22, as described below, slide the sliding sear blocking plate 26 to the right. In this position, the flat rear end 30 of the plate 26 engages under the hook end 18 of the sear 16. In this manner, the sear 16 is prevented from rotation about its axis in the counterclockwise direction, the direction of the arrow in FIG. 2. With this configuration, the striker 14 and its finger 20 cannot move past engagement of the finger 20 against the hook 18, and the weapon is disenabled from firing.

FIG. 2 shows the "FIRE" position. Note that the cam 22 has been rotated in the clockwise direction with respect to its position in FIG. 1. The cam finger 32 is nested in a suitably formed slot in the plate 26, thus not interfering with the motions of bolt 10 or striker 14. However, significantly, the act of rotating the cam 22 from the FIG. 1 to the FIG. 2 position has also caused spring 24 to in turn cause a sliding motion of the plate 26 from the blocking FIG. 1 position to the "FIRE" FIG. 2 position. That is, the end 30 is no longer engaged with any part of the sear 16, and action of the trigger will permit rotation of the sear, release of the striker 14, and firing of the weapon.

As is clear from FIGS. 1 and 2, the cam 22 is larger in one dimension (vertical in FIG. 2) than in the other (vertical in FIG. 1). These dimensions correlate to the "throw" of plate 26, the amount of its motion. The driving force is from cam 22 (by either manual operation or automatic action from bolt 10, via spring 24) (spring arm 34 bears on a tab 36 on the end of plate 26) to move from SAFE to FIRE. To move in the opposite direction from FIRE to SAFE a lobe on cam 22 bears directly on the opposite side of tab 36 to thus positively move the plate and the spring via the plate.

The dimensions of the cam stretch the legs of spring 24 apart in the SAFE FIG. 1 position. To move to the FIRE position, the cam moves to the FIG. 2 position, this reduces the force on the legs of the spring, the legs pull together and in so doing leg 34 draws plate 26 from the FIG. 1 to the FIG. 2 position.

The invention permits change of position of the cam 22 in two different ways. First of all, in the conventional manner by rotation of the rod about its axis 31 manually from the outside of the weapon. More importantly, the significant improvement of the invention is that this same rotation of cam 22 and subsequent enabling or motion to the "FIRE" position can be accomplished by simply cocking the bolt 10, that is, moving it rearwardly (in the drawings) and then forwardly. This is the normal action to prepare a weapon for firing. When that occurs, the bolt will strike the finger 32 of cam 22, rotate it to the FIG. 2 position, this will in turn cause the spring 24 to in turn slide the plate 26 to the left, to enable firing of the weapon.

Thus, in an emergency situation, the user of the weapon need not concern himself or herself about the safety at all. The user simply cocks the weapon, the safety is automatically moved to the "FIRE" position, and firing of the weapon can commenced at once. The life endangering extra procedures of having to manually move the safety mechanism from "SAFE" to "FIRE" is thus totally eliminated. However, the usual assurance against accidental firing of the weapon by having a conventional SAFE position is also present according to the invention. This is a very substantial and significant step forward in the art of weapons which is achieved by the present invention.

While the invention has been described in detail above, it is to be understood that this detailed description is by way of example only, and the protection granted is to be limited only within the spirit of the invention and the scope of the following claims.

I claim:

1. In a firearm having movable bolt means and safety means, said safety means defining an enabled FIRE position and a disabled SAFE position of said firearm, and said safety means being capable of manual motion between said SAFE and said FIRE positions, the improvement comprising means to automatically upon manual cocking of said bolt means move said safety means from said SAFE position to said FIRE position, said firearms also comprising striker means adapted to strike said bolt means to fire the firearm, said firearm also comprising sear means for operating said striker means, said safety means comprising cam means having two positions corresponding to said FIRE and SAFE positions respectively, said cam means comprising a portion which in said SAFE position prevents motion of said striker means towards said bolt means, and said safety means being so configured that upon cocking of said bolt means when said firearm is in said SAFE position said bolt means will strike said cam means preventing portion and will automatically move said cam means and said safety means from said SAFE to said FIRE position.

2. The firearm of claim 1, said firearm also comprising a sear which controls the motion of said striker means with respect to said bolt means, said safety means comprising a sear blocking plate means and spring means associated with said cam means, said sear blocking plate means holding said sear in said SAFE position to prevent said striker means from moving towards said bolt means; and said cam means and said spring means being so configured and arranged that upon manual cocking of said bolt means said cam means is moved by said bolt means, said cam means in turn moves said spring means, and said spring means in turn moves said blocking plate means to a position where said sear is no longer blocked from motion to thereby move said firearm into said FIRE position.

3. The firearm of claim 1, and said cam means being mounted for rotation about an axis, whereby said automatic motion of said cam means is rotational motion, and manually operable means cooperable with said cam means for manually rotating said cam means together with said safety means between said SAFE and FIRE positions.

4. In a firearm having bolt means and striker means adapted to strike said bolt means to fire the firearm, said firearm also comprising sear means for operating said striker means and manually operable safety means, said safety means defining an enabled FIRE position and a disabled SAFE position of said firearm, said safety means being capable of manual motion between said SAFE and said FIRE positions, said firearm comprising means defining a line of motion along which said bolt means and said striker means move during firing of said firearm, said safety means comprising cam means having two positions corresponding to said FIRE and SAFE positions respectively, said cam means comprising a portion which in said SAFE position extends into said line of motion, and said safety means being so configured that upon cocking of said bolt means when said firearm is in said SAFE position said bolt means will strike said cam means extending portion and will automatically move said cam means and said safety means from said SAFE to said FIRE position.

5. The firearm of claim 4, said cam means extending position comprising a finger portion.

6. The firearm of claim 5, said firearm also comprising a sear which controls the motion of said striker means with respect to said bolt means, said safety means comprising a sear blocking plate means and spring means associated with said cam means, said sear blocking plate means holding a portion of said sear across said line of motion in said SAFE position to prevent said striker means from moving towards said bolt means; and said cam means and said spring means being so configured and arranged that upon manual cocking of said blot means said cam means is moved by said bolt means, said cam means in turn moves said spring means, and said spring means in turn moves said blocking plate means to a position where said sear is no longer blocked from motion to thus move said safety to said FIRE position of said firearm.

7. The firearm of claim 4, and said cam means being mounted for rotation about an axis, whereby said automatic motion of said cam means is rotational motion, and manually operable means cooperable with said cam means for manually rotating said cam means together with said safety means between said SAFE and FIRE positions.

* * * * *